US012504222B2

(12) United States Patent
Choi

(10) Patent No.: US 12,504,222 B2
(45) Date of Patent: Dec. 23, 2025

(54) REFRIGERATOR

(71) Applicant: LG ELECTRONICS INC., Seoul (KR)

(72) Inventor: Kwang Hyun Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 181 days.

(21) Appl. No.: 18/102,334

(22) Filed: Jan. 27, 2023

(65) Prior Publication Data

US 2023/0243579 A1 Aug. 3, 2023

(30) Foreign Application Priority Data

Jan. 28, 2022 (KR) ..... 10-2022-0013688

(51) Int. Cl.
*F25D 25/02* (2006.01)
*F25D 17/08* (2006.01)
*F25D 23/06* (2006.01)

(52) U.S. Cl.
CPC ..... *F25D 25/025* (2013.01); *F25D 17/08* (2013.01); *F25D 23/067* (2013.01)

(58) Field of Classification Search
CPC ..... F25D 25/025; F25D 23/067; F25D 17/08
See application file for complete search history.

(56) References Cited

U.S. PATENT DOCUMENTS 5,044,704 A * 9/1991 Bussan ..... F25D 25/025 312/402
9,185,979 B1 * 11/2015 Jenks ..... A47B 96/066
2012/0273504 A1 * 11/2012 Rackley ..... F25D 25/025 220/592.02
2014/0265808 A1 * 9/2014 Kendall ..... A47B 88/477 312/408
2022/0082311 A1 * 3/2022 Yoo ..... F25B 39/04
2022/0408941 A1 * 12/2022 Hwang ..... F25D 23/028

FOREIGN PATENT DOCUMENTS

KR 10-2014-0040395 4/2014

* cited by examiner

*Primary Examiner* — Jerry-Daryl Fletcher
*Assistant Examiner* — Keith Stanley Myers
(74) *Attorney, Agent, or Firm* — KED & ASSOCIATES, LLP

(57) ABSTRACT

A refrigerator comprises a frame being held at a refrigerating case, a storage drawer being supported by the frame and moving in a front-rear direction with respect to the frame, and a supporter being coupled to the frame, the supporter comprising a first supporter panel having a first width in the front-rear direction and having a plate shape elongated in a left-right direction, a third supporter panel being disposed under the first supporter panel, having a second width in the front-rear direction and having a plate shape elongated in the left-right direction, and a second supporter panel connecting between the first supporter panel and the second supporter panel, having a predetermined height in an up-down direction and having a plate shape elongated in the left-right direction.

20 Claims, 11 Drawing Sheets

REFRIGERATOR

CROSS-REFERENCE TO RELATED APPLICATION(S)

This application claims priority to and the benefit of Korean Patent Application No. 10-2022-0013688, filed in Korea on Jan. 28, 2022, the disclosure of which is incorporated herein by reference in its entirety.

BACKGROUND

1. Field

Disclosed herein is a refrigerator comprising a storage drawer.

2. Background

Refrigerators generate cold air by circulating refrigerants and provide the cold air to a storage compartment such as a refrigerating compartment or a freezing compartment, to store various types of storage targets for a long period of time and keep the storage targets fresh in the storage compartment. Refrigerators operate based on a refrigeration cycle in which refrigerants pass through a compressor, a condenser, an expansion valve and an evaporator. The temperature of the air circulating in the refrigerator is lowered while refrigerant liquids turn into refrigerant gases in the evaporator, such that cold air to be provided to the refrigerating compartment and the freezing compartment is generated.

In general, refrigerators include storage drawers for storing vegetables and the like. The storage drawer is supported by a frame held at the refrigerator in a way that the storage drawer can be drawn.

Currently, there is a growing demand for a large-sized refrigerator with a refrigerating compartment of a large volume. Accordingly, the size of the storage drawer increases, and a load applied to the frame also increases. When the frame bends due to the load, the exterior of the refrigerator deteriorates, and it is difficult for the user to draw the storage drawer properly.

BRIEF DESCRIPTION OF THE DRAWINGS

Embodiments will be described in detail with reference to the following drawings in which like reference numerals refer to like elements, and wherein:

FIG. 3 is a front view showing the refrigerator of one embodiment, and the front surface of the refrigerator without doors, selves, drawers and the like;

DETAILED DESCRIPTION

Figure 1:
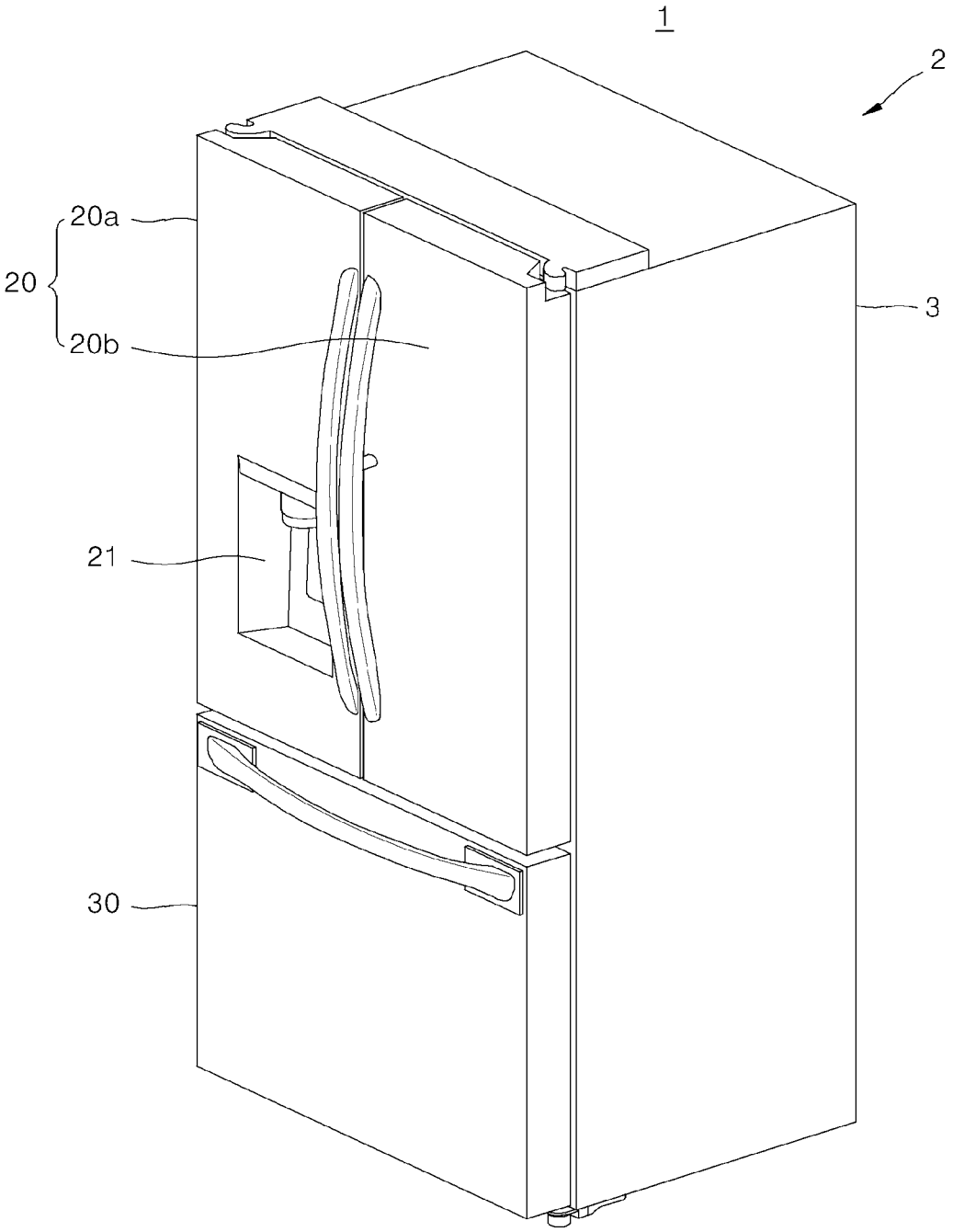
FIG. 1 is a front perspective view showing a refrigerator of one embodiment with doors closed.

The below-described aspects, features and advantages are specifically described hereafter with reference to the accompanying drawings such that one having ordinary skill in the art to which the present disclosure pertains can embody the technical spirit of the disclosure easily. In the disclosure, detailed description of known technologies in relation to the disclosure is omitted if it is deemed to make the gist of the disclosure unnecessarily vague. Hereafter, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component, unless stated to the contrary.

When any one component is described as being "in the upper portion (or lower portion)" or "on (or under)" another component, any one component can be directly on (or under) another component, but an additional component can be interposed between any one component and another component on (or under) any one component. When any one component is described as being "connected", "coupled", or "connected" to another component, any one component can be directly connected or coupled to another component, but an additional component can be "interposed" between the two components or the two components can be "connected", "coupled", or "connected" by an additional component.

Throughout the disclosure, each component can be provided as a single one or a plurality of ones, unless explicitly stated to the contrary. The singular forms "a", "an" and "the" are intended to include the plural forms as well, unless explicitly indicated otherwise. It is to be understood that the terms "comprise" or "include" and the like, set forth herein, are not interpreted as necessarily including all the stated components or steps but can be interpreted as excluding some of the stated components or steps or can be interpreted as including additional components or steps. Throughout the disclosure, the phrase "A and/or B" as used herein can denote A, B or A and B, and the phrase "C to D" can denote C or greater and D or less, unless stated to the contrary.

Figure 2:
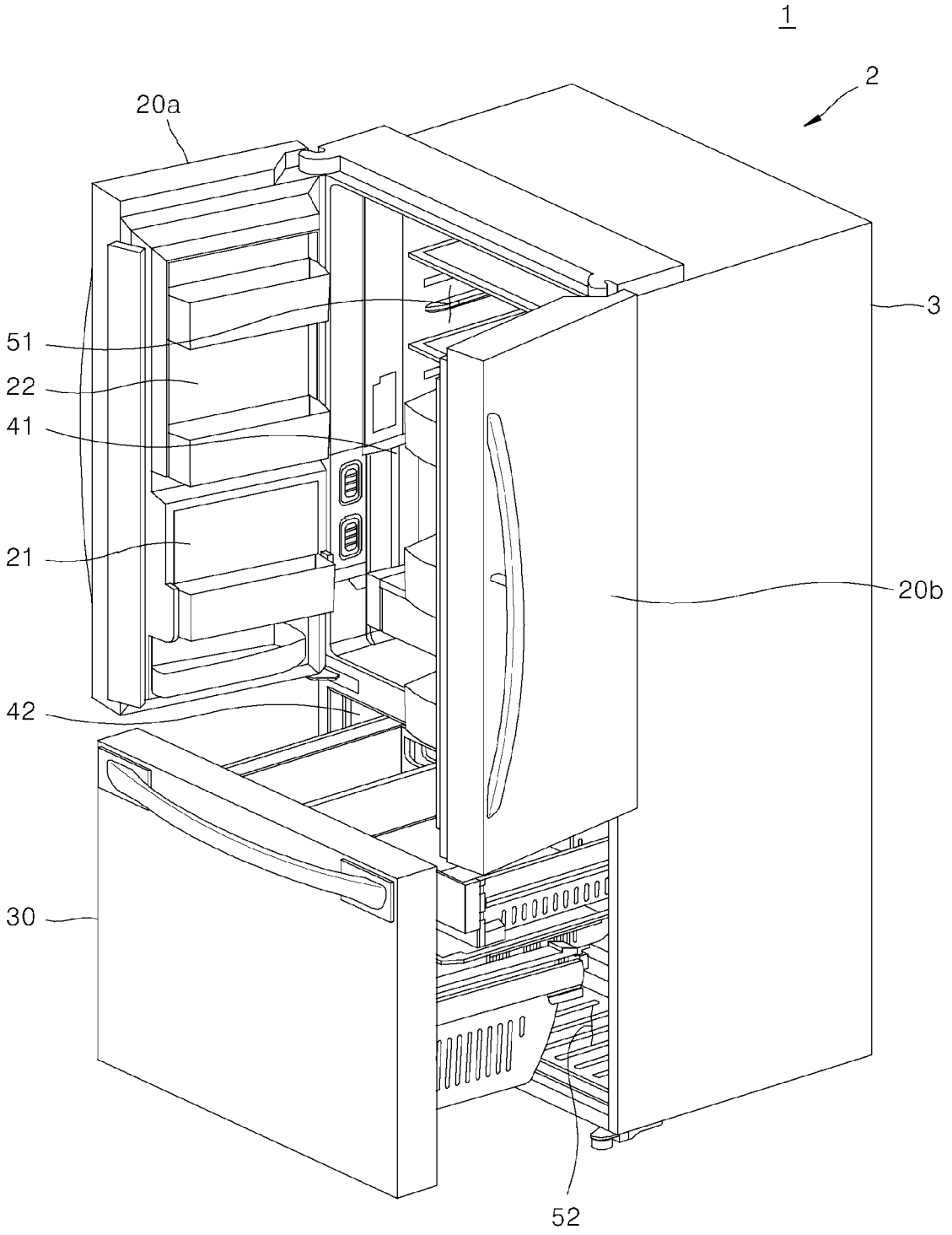
FIG. 2 is a front perspective view showing the refrigerator of one embodiment with the doors open.

Hereafter, a refrigerator of several embodiments is described. FIG. 1 is a front perspective view showing a refrigerator 1 of one embodiment with doors closed, and FIG. 2 is a front perspective view showing the refrigerator 1 of one embodiment with the doors open. The exterior of the refrigerator 1 of one embodiment may be formed by a cabinet 2 forming a storage space, and doors 20, 30 opening and closing the front surface of the cabinet 2, which is open.

The cabinet 2 may comprise an outer case 3 forming the outer surface of the refrigerator 1, and an inner case forming the inner surface of the refrigerator 1. The inner case may comprise a refrigerating case 41 and a freezing case 42.

A separation space may be formed between the outer case 3 and the inner case 41, 42 that are spaced from each other. An insulation material may foam in the separation space and fill the space between the outer case 3 and the inner case 41.

The storage space in the cabinet 2 may be portioned into a plurality of spaces, and divided into a refrigerating compartment 51 and a freezing compartment 52. In one embodiment, the freezing compartment 52 may be disposed in the lower space of the cabinet 2, and the refrigerating compartment 51 may be disposed in the upper space of the cabinet 2, but not limited.

A door may connect to the front surface of the cabinet 2, and open and close the refrigerator 1. An upper door 20 may be disposed on the front surface of the cabinet 2, which corresponds to the refrigerating compartment 51, and a lower door 30 may be disposed on the front surface of the cabinet 2, which corresponds to the freezing compartment 52.

The upper door 20 may be a rotary one that has a rotation shaft and rotates. The upper door 20 may comprise a first upper door 20*a* and a second upper door 20*b* that respectively have a rotation shaft disposed at both sides of the cabinet 2, and rotate. The lower door 30 may be a drawer-type one that moves to be drawn or inserted along a rail, in a sliding manner.

A dispenser part 21 may be disposed at the first upper door 20*a* such that water or ice may be taken out in the state where the door is not open. Additionally, a door ice maker 22 generating ice may be disposed at the first upper door 20*a* at which the dispenser part 21 is disposed.

Figure 3:
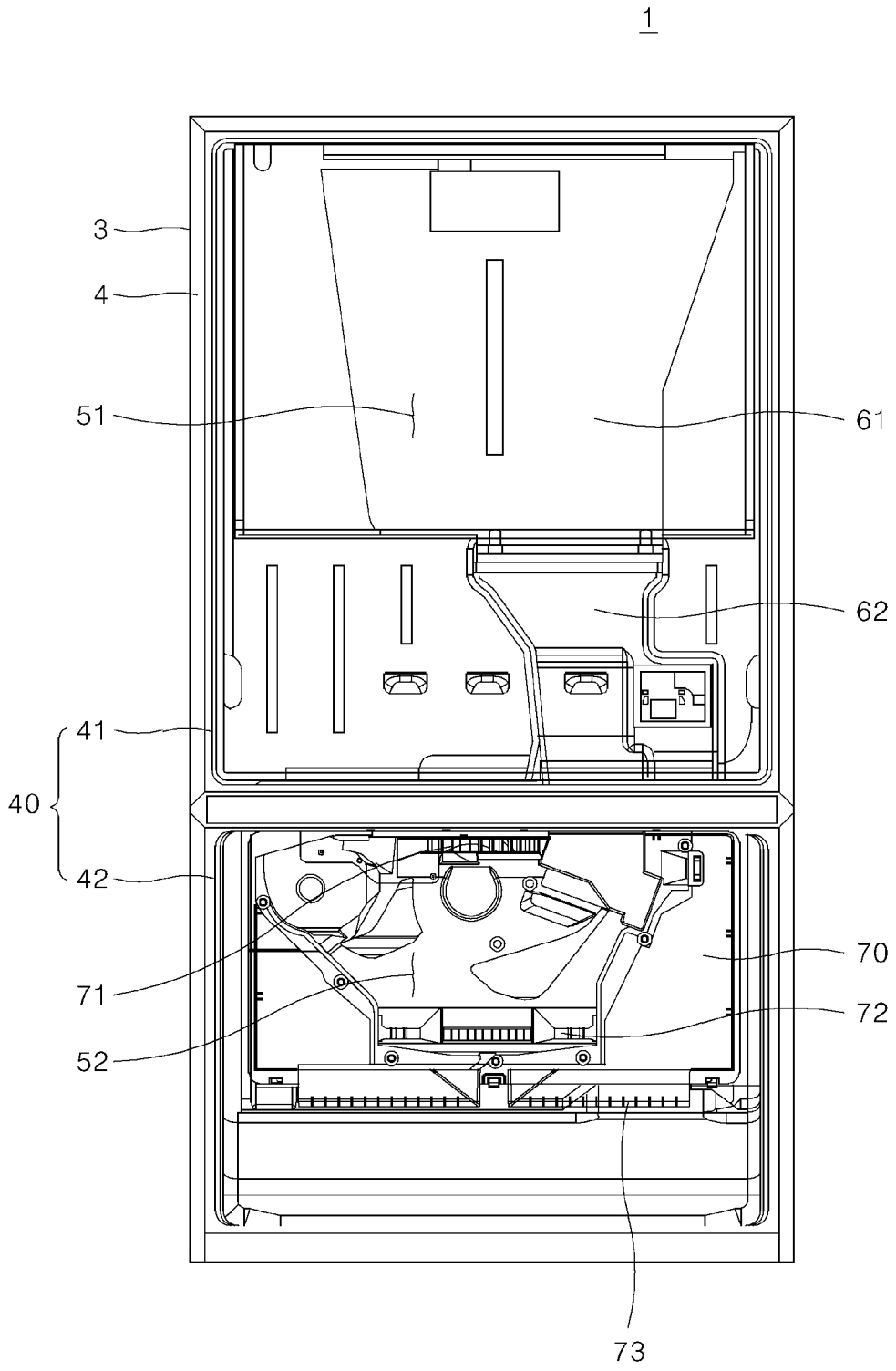

FIG. 3 is a front view showing the refrigerator of one embodiment, and the front surface of the refrigerator without doors, selves, drawers and the like. As described above, the outer case 3 and the inner case 40 may have a separation space therebetween, and the separation space may be formed between the outer case 3 and the inner case 40 that are spaced from each other. The space between the outer case 3 and the inner case 40 may be filled with an insulation material 4. The inner case 40 may comprise a refrigerating case 41 being disposed in the upper portion of the outer case 3 and constituting the refrigerating compartment 51, and a freeze case 42 being disposed in the lower portion of the outer case 3 and constituting the freezing compartment 52.

A refrigerating compartment cold air supply duct 61 for supplying cold air to the refrigerating compartment 51 may be disposed in the upper portion of the rear surface of the refrigerating case 41. In one embodiment, to deliver cold air to the refrigerating compartment cold air supply duct 61, a connection duct (not illustrated) may be disposed between a grille fan assembly 70 and the refrigerating compartment cold air supply duct 61. The connection duct (not illustrated) may be disposed between the refrigerating case 41 and the outer case 3. To this end, a rear surface protrusion part (or rear surface protrusion) 62 may be disposed at the refrigerating case 41, and protrude toward the inside of the refrigerating case 41. That is, the connection duct (not illustrated) may be disposed at the rear of the rear surface protrusion part 62 of the refrigerating case 41.

The refrigerating compartment cold air supply duct 61 may be disposed inside the refrigerating case 41, the connection duct (not illustrated) may be disposed outside the refrigerating case 41, and the refrigerating compartment cold air supply duct 61 and the connection duct (not illustrated) may communicate with each other on the rear surface of the refrigerating case.

As described above, the insulation material 4 exhibiting a very low thermal conductivity may foam between the inner case 40 and the outer case 3 to fill the space between the inner case 40 and the outer case 3. In one embodiment, the connection duct (not illustrated) may be disposed to pass through the space between the inner case 40 and the outer case 3, wherein foam is produced with the insulation material 4.

Accordingly, as the upper door 20 of the refrigerator 1 is opened, the refrigerating compartment cold air supply duct 300 disposed inside the refrigerating case 41 may be exposed outward, while the connection duct (not illustrated) disposed outside the refrigerating case 41 may not be exposed outward. Additionally, since no additional insulation material for the connection duct is required, the storage space of the refrigerator 1 may expand further.

The grille fan assembly 70 may be disposed on the rear surface of the freezing case 42. The grille fan assembly 70 may comprise a grille fan upper outlet 71 and a grille fan lower outlet 72 that discharge cold air to the freezing compartment 52, and an inlet 73 into which cold air in the freezing compartment 52 is suctioned.

Figure 4:
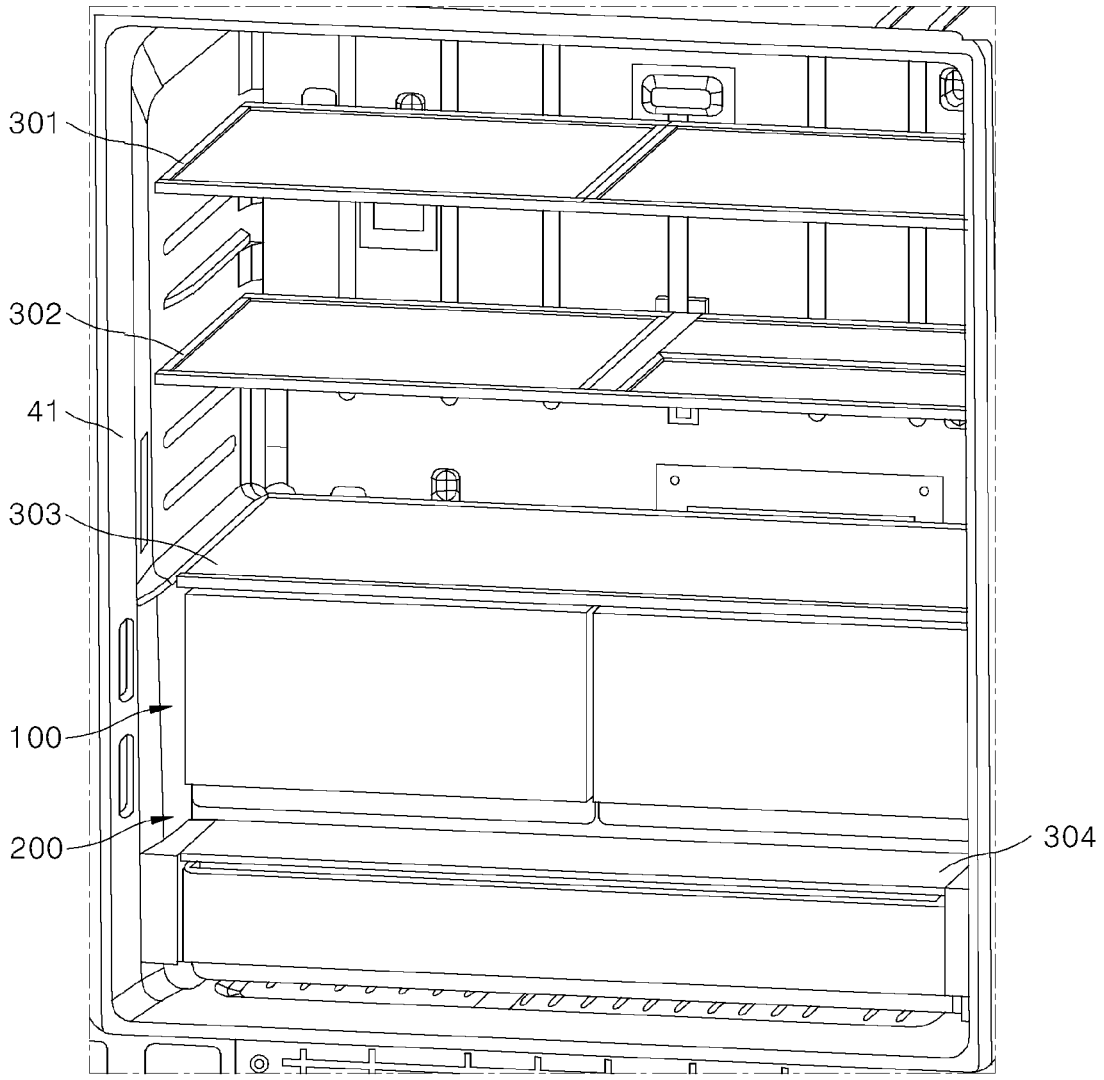
FIG. 4 is a schematic view showing a refrigerating compartment of the refrigerator of one embodiment.

FIG. 4 is a schematic view showing the refrigerating compartment 51 of the refrigerator 1 of one embodiment. The refrigerating compartment 51 may be portioned into a plurality of sections by a plurality of shelves 301, 302, 303. Each of the plurality of shelves 301, 302, 303 may be supported by a shelf holding part disposed on the lateral surface of the refrigerating case 41. Each of the plurality of shelves 301, 302, 303 may be detachably coupled to the shelf holding part.

In one embodiment, a storage drawer 100, and a frame 200 supporting the storage drawer 100 may be disposed in the refrigerating compartment 51. The frame 200 may be held at the inner case 41. The configuration in which the frame 200 is held at the inner case 41 is described hereafter with reference to FIGS. 11 to 13. The storage drawer 100 may be supported by the frame 200 in a way that the storage drawer 100 can be drawn. A shelf 304 may be additionally disposed under the front of the frame 200.

In one embodiment, a pantry compartment 400 may be further provided under the storage drawer 100 of the refrigerating compartment 51. The pantry compartment 400 may distinguish from another portion (i.e., a main storage compartment) of the refrigerating compartment 51, and its temperature may be adjusted by an additional temperature sensor, apart from the main storage compartment's temperature. The pantry compartment 400 may comprise a pantry drawer that is drawn and/or inserted along a rail, in a sliding manner.

Figure 5:
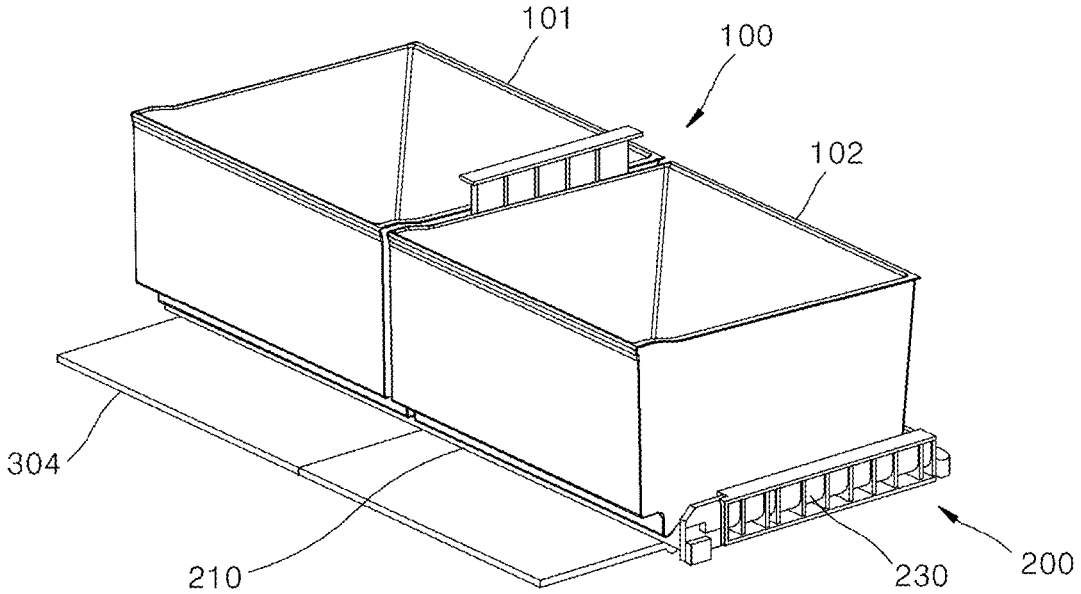
FIGS. 5 and 6 are views showing a storage drawer portion of the refrigerator of one embodiment and showing that a storage drawer is closed.
Figure 6:
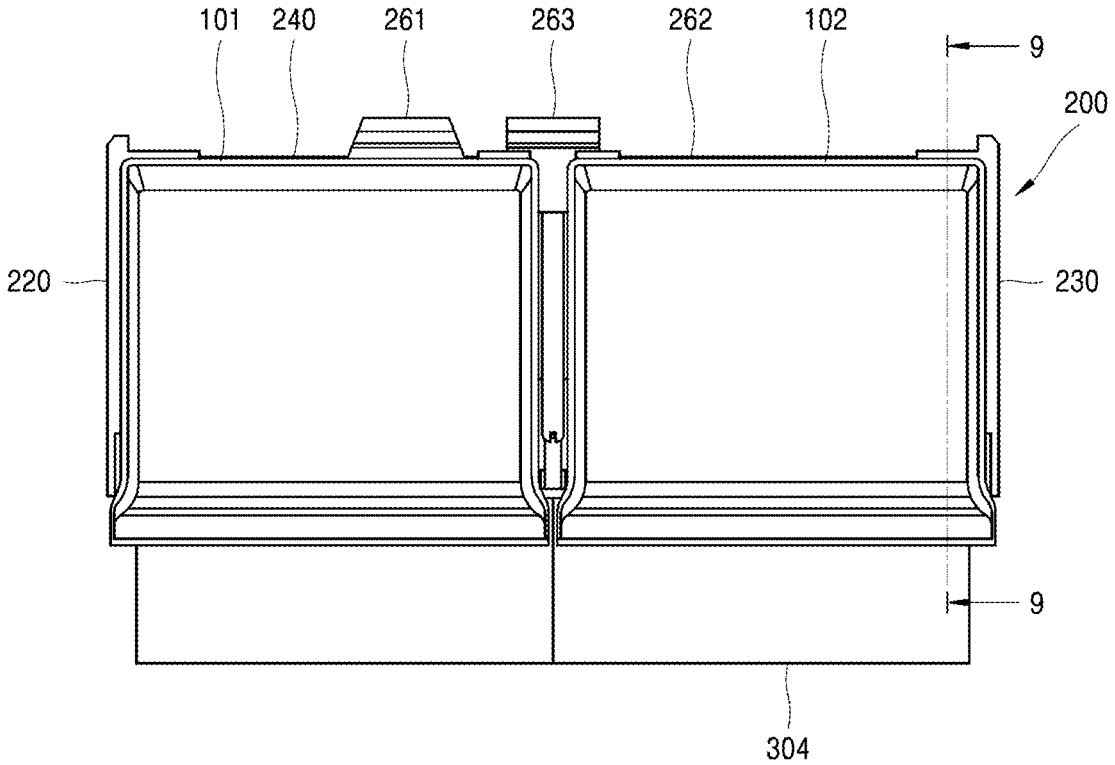
Figure 7:
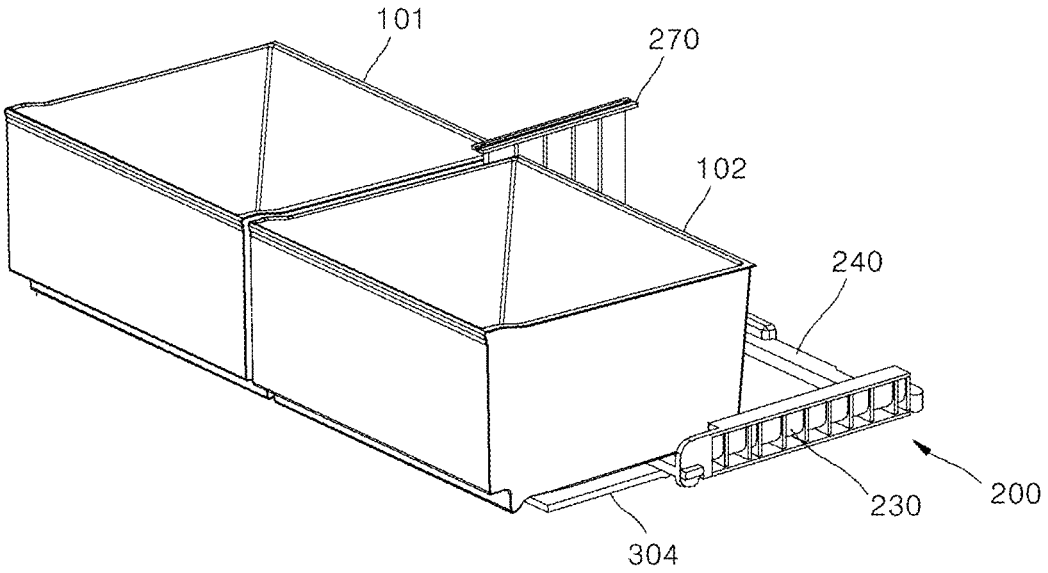
FIGS. 7 and 8 are views showing a storage drawer portion of the refrigerator of one embodiment and showing that a storage drawer is open.
Figure 8:
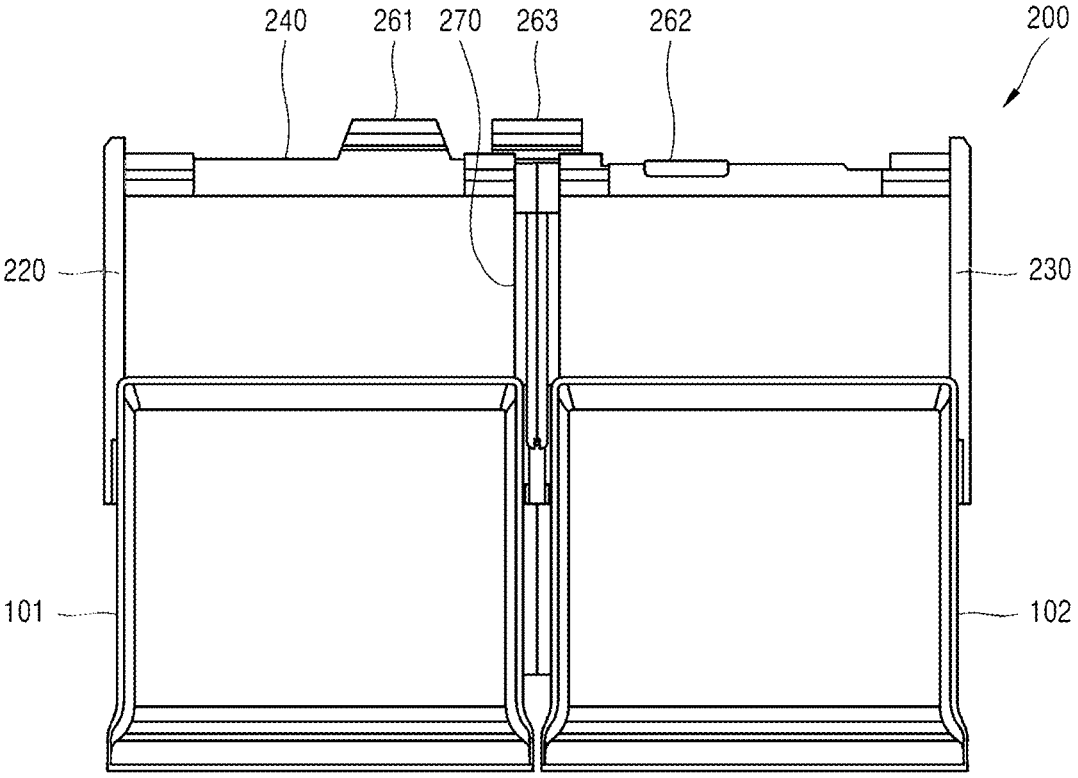

FIGS. 5 to 6 show a storage drawer portion of the refrigerator of one embodiment. Specifically, FIG. 5 is a perspective view showing that a storage drawer is closed, FIG. 6 is a plan view showing that a storage drawer is closed, FIG. 7 is a perspective view showing that a storage drawer is open, and FIG. 8 is a plan view showing that a storage drawer is open.

The storage drawer 100 may be supported by the frame 200. Additionally, the storage drawer 100 may move in the front-rear direction, with respect to the frame 200. When viewed from the front, the storage drawer 100 may comprise a first storage drawer 101 disposed at the left side of the refrigerating case 41, and a second storage drawer 102 disposed at the right side of the refrigerating case 41.

When viewed from above, the first storage drawer 101 may be disposed at the left side of the frame 200, and supported by the frame 200 in a way that the first storage drawer 101 can be drawn. When viewed from above, the second storage drawer 102 may be disposed at the right side of the frame 200, and supported by the frame 200 in a way that the second storage drawer 102 can be drawn.

The frame 200 may comprise a front frame 210, a first side frame 220, a second side frame 230, a rear frame 240, and a middle frame 250. One end of the left side of the front frame 210 may connect to the front end of the first side frame 220, one end of the right side of the front frame 210 may connect to the front end of the second side frame 230, the rear frame 240 may connect between the rear end of the first side frame 220 and the rear end of the second side frame 230, and the middle frame 210 may connect between the middle point of the front frame 210 and the middle point of the rear frame 240.

Accordingly, the first storage drawer 101 may be supported by the front frame 210, the first side frame 220, the rear frame 240 and the middle frame 250 in a way that the first storage drawer 101 can be drawn, while the second storage drawer 102 may be supported by the front frame 210, the second side frame 220, the rear frame 240 and the middle frame 250 in a way that the second storage drawer 102 can be drawn.

In the state where the first storage drawer 101 and/or the second storage drawer 102 is closed (i.e., in the state where the first storage drawer 101 and/or the second storage drawer 102 is inserted into the refrigerating compartment 51), the front end portion of the first storage drawer 101 and/or the second storage drawer 102 may be placed on the front frame 210. Additionally, in the state where the first storage drawer 101 and/or the second storage drawer 102 is completely open (i.e., in the state where the first storage drawer 101 and/or the second storage drawer 102 is drawn to a maximum degree without separating from the frame), the rear end portion of the first storage drawer 101 and/or the second storage drawer 102 may be placed on the front frame 210. The front end portion indicates the anterior portion from the middle of the first storage drawer 101 and/or the second storage drawer 102 with respect to the front-rear direction, and the rear end portion indicates the posterior portion from the middle of the first storage drawer 101 and/or the second storage drawer 102 with respect to the front-rear direction.

Frame holding parts (or frame holding regions) 261, 262, 263 may be disposed at the rear of the rear frame 240. The frame holding parts 261, 263, 263 may be respectively coupled to case holding parts disposed at the refrigerating case 41, to fix the frame 200 to the refrigerating case 41.

A third frame holding part 263 may be disposed at the rear of the middle of the rear frame 240. That is, the third frame holding part 263 may be disposed in the rear portion of a portion of the rear frame 240, to which the middle frame 250 connects.

When viewed from the front, the first frame holding part 261 may be disposed at the left side of the third frame holding part 263. When viewed from the front, the second frame holding part 262 may be disposed at the right side of the third frame holding part 263. A distance between the inner surface of the first side frame 220 and the middle of the first frame holding part 261, a distance between the middle of the first frame holding part 261 and the middle of the second frame holding part 262, and a distance between the second frame holding part 262 and the inner surface of the second side frame 230 may be substantially the same. Herein, being substantially the same or substantially similar means that the distances differ by less than 10%. The above-described arrangement helps the frame 200 to be stably held at the refrigerating case 41.

In some embodiments, the third frame holding part 263 may be omitted. However, the addition of the third frame holding part 263 may help the frame 200 to be held at the refrigerating case 41 more stably, and prevent a bend and the like caused by a load more effectively. The first frame holding part 261 and the third frame holding part 263 may be disposed to protrude rearward from the rear surface of the rear frame 240, and the second frame holding part 262 may be concavely formed forward from the rear surface of the rear frame 240.

In one embodiment, the refrigerator 1 may further comprise a shelf support member (or shelf support) 270. The shelf support member 270 may be coupled to the upper portion of the frame 200 (specifically, the middle frame 250), and support a shelf 303 disposed on the storage drawer 100. The shelf support member 270 may support the middle portion of the shelf 303 in the left-right direction. When viewed from a side, the shelf support member 270 may have a flat plate shape. The lower portion of the shelf support member 270 may be coupled to the frame 200 (specifically, the middle frame 250). The upper portion of the shelf support member 270 may have a flat plate shape that is elongated in the front-rear direction to support the shelf 303 stably.

Figure 9:
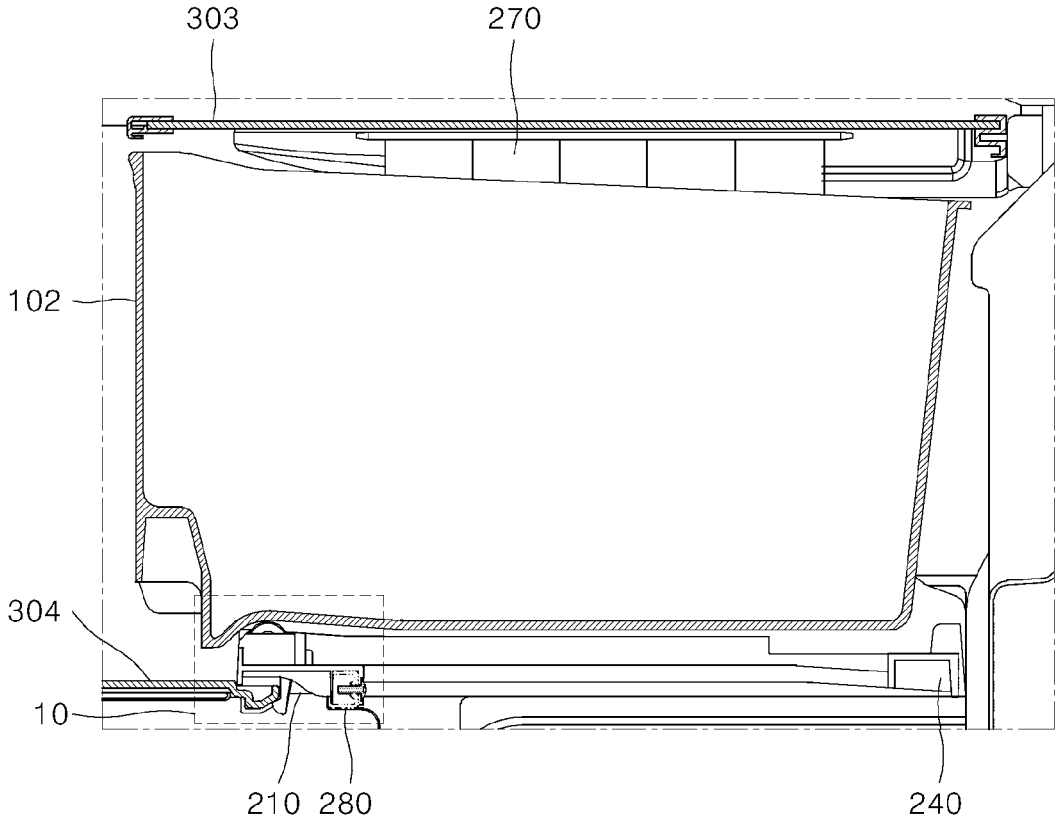
FIG. 9 is a cross-sectional view showing a storage drawer portion of the refrigerator of one embodiment.
Figure 10:
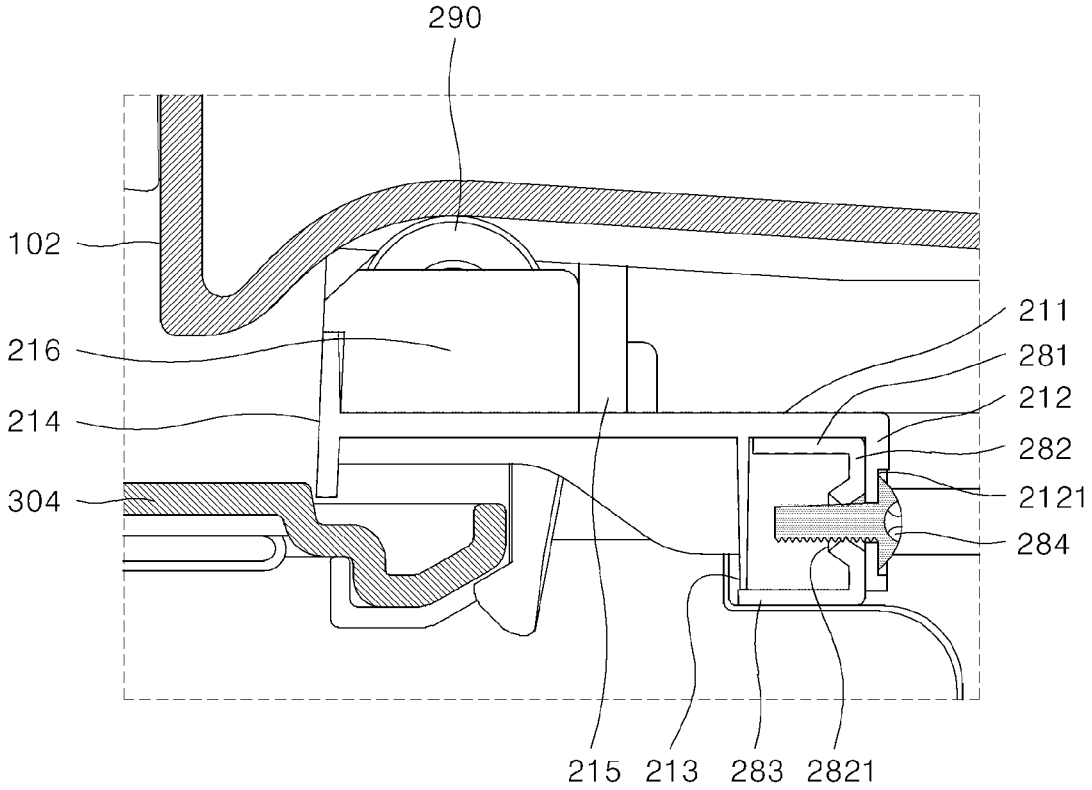
FIG. 10 is an enlarged view showing a supporter portion in the cross-sectional view of FIG. 9.

FIG. 9 is a cross-sectional view showing a storage drawer portion of the refrigerator of one embodiment, and a cross-sectional view showing portion 9-9' in FIG. 6, and FIG. 10 is an enlarged view showing a supporter portion (i.e., portion 10) in the cross-sectional view of FIG. 9. Referring to FIG. 9, a shelf 304 may connect to the frame 200, at the front of the frame 200. Specifically, the shelf 304 may be coupled to the front frame, under the front of the front frame 210. Referring to FIGS. 7 and 8, the shelf 304 may support the storage drawer 100 when the storage drawer 100 is drawn forward.

The rear end portion of the storage drawer 100 may be supported by the rear frame 240 when the storage drawer 102 is closed. A drawer stopper 112 may be disposed in the lower end portion of the storage drawer 102. The drawer stopper 112 may allow the storage drawer 102 to be drawn up to a maximum predetermined drawn point. An additional external force may be needed to separate the storage drawer 102 completely past the maximum drawn point. Specifically, when the storage drawer 102 is lifted slightly and pulled forward, the storage drawer 102 may separate completely.

A supporter 280 may be made of steel. The supporter 280 may be coupled to the frame 200, under the frame 200. Specifically, the supporter 280 may be coupled to the lower portion of the front frame 210. At this time, the supporter 280 may be coupled by using the front frame and a bolt, and the bolt may be fastened in the front-rear direction.

Referring to FIG. 10, the front frame 210 may comprise a first frame panel 211 that has a plate shape elongated in the left-right direction, a second frame panel 212 that extends downward from the rear end of the first frame panel 211 and has a plate shape elongated in the left-right direction, a third frame panel 213 that extends downward from the lower surface of the first frame panel 211 at the front of the second frame panel 212 and has a plate shape elongated in the left-right direction, and a fourth frame panel 214 that has a predetermined height in the up-down direction, has a plate shape elongated in the left-right direction and connects to the front end of the first frame panel 211. The second frame panel 212 may have a frame panel coupling hole that is formed in a way that penetrates in the front-rear direction.

The supporter 280 may comprise a first supporter panel 281 that has a first width in the front-rear direction and has a plate shape elongated in the left-right direction, a third supporter panel 283 that has a second width in the front-rear direction and has a plate shape elongated in the left-right direction, and a second supporter panel 282 that connects between the first supporter panel 281 and the third supporter panel 283 and has a plate shape elongated in the left-right direction. The second supporter panel 282 may connect between the rear end of the first supporter panel 281 and the rear end of the third supporter panel 283. Additionally, the second width may be greater than the first width.

The supporter 280 may be inserted into a space formed by the first frame panel 211, the second frame panel 212 and the third frame panel 213. Additionally, the lower end portion of the third frame panel 213 may contact the upper surface of the third supporter panel 283. The upper surface of the first supporter panel 281 may contact the upper surface of the first frame panel 211.

The second frame panel 212 may have a frame panel coupling hole 2121 that is formed in a way that penetrates in the front-rear direction. Additionally, the second supporter panel 282 may have a supporter panel coupling hole 2821 that is formed in a way that penetrates in the front-rear direction. The supporter 280 and the frame 200 (specifically, the front frame 210) may be coupled by a bolt or other coupling 284 that passes through the frame panel coupling hole 2121 and the supporter panel coupling hole 2821. The supporter 280 configured as described above may ensure improvement in the strength of a shape, a reduction in the height of the frame 200 and a decrease in the material costs than a supporter coupled to the frame 200 through a coupling hole that is formed in a way that penetrates in the up-down direction.

In one embodiment, the frame 200 may further comprise a wheel housing 216 and a wheel 290. The wheel housing 216 may be disposed over the front frame 210 (specifically, the first frame panel 211), and form a space that accommodates the wheel 290. The wheel 290 may be rotatably coupled to the wheel housing 216, in the wheel housing 216. The wheel 290 may be rotated by friction with the storage drawer 100 such that the storage drawer is drawn smoothly.

In one embodiment, the frame 200 may further comprise a frame stopper 215. The frame stopper 215 may be disposed over the front frame 210 (specifically, the first frame panel 211), have a predetermined height in the up-down direction and have a plate shape elongated in the left-right direction. As the storage drawer 100 is drawn, the frame stopper 215 and the drawer stopper 112 may contact each other and limit a range in which the storage drawer 100 is drawn. The frame stopper 215 may be disposed at the rear end of the wheel housing 216.

Figure 11:
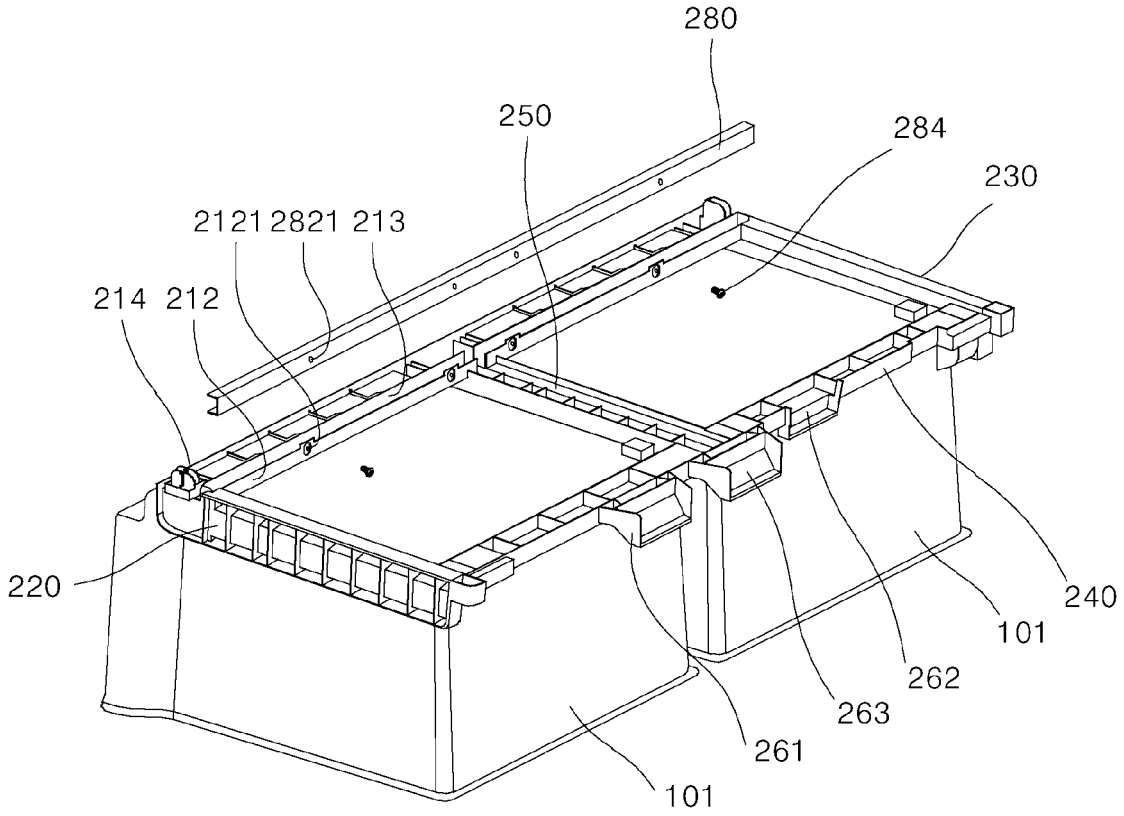
FIG. 11 is an exploded perspective view showing a storage drawer portion of the refrigerator of one embodiment.

FIG. 11 is an exploded perspective view showing a storage drawer portion of the refrigerator of one embodiment. As described above, the frame 200 may comprise a front frame 210, a first side frame 220, a second side frame 230, a rear frame 240, and a middle frame 250. The front frame 210 may comprise a first frame panel 211, a second frame panel 212, a third frame panel 213 and a fourth frame panel 214.

The supporter 280 may be inserted into a space formed by the first frame panel 211, the second frame panel 212 and the third frame panel 213. At this time, the supporter 280 may be coupled by the bolt 284 that passes through the frame panel coupling hole 2121 formed at the second frame panel 212, and the supporter panel coupling hole 2821 (FIG. 10) formed at the second supporter panel 282 (FIG. 10) of the supporter 280. The frame panel coupling hole 2121 and the supporter panel coupling hole 2821 (FIG. 10) may be holes that penetrate in the front-rear direction.

Frame holding parts 261, 262, 263 may be disposed at the rear frame 240. Each of the frame holding parts 261, 262, 263 may comprise a groove that is concave forward, and a cover that covers the upper surface and both of the lateral surfaces of the groove.

Figure 12:
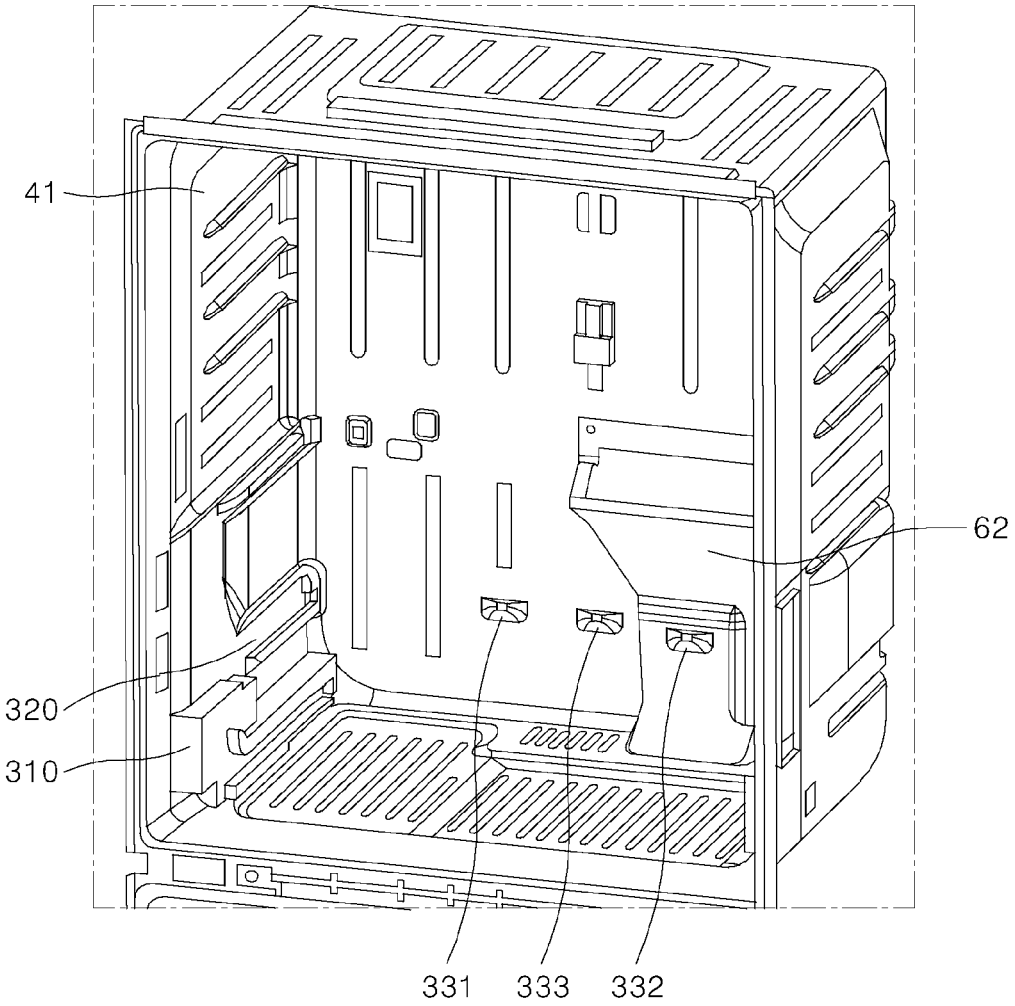
FIG. 12 is a schematic view showing the refrigerating compartment of the refrigerator of one embodiment.
Figure 13:
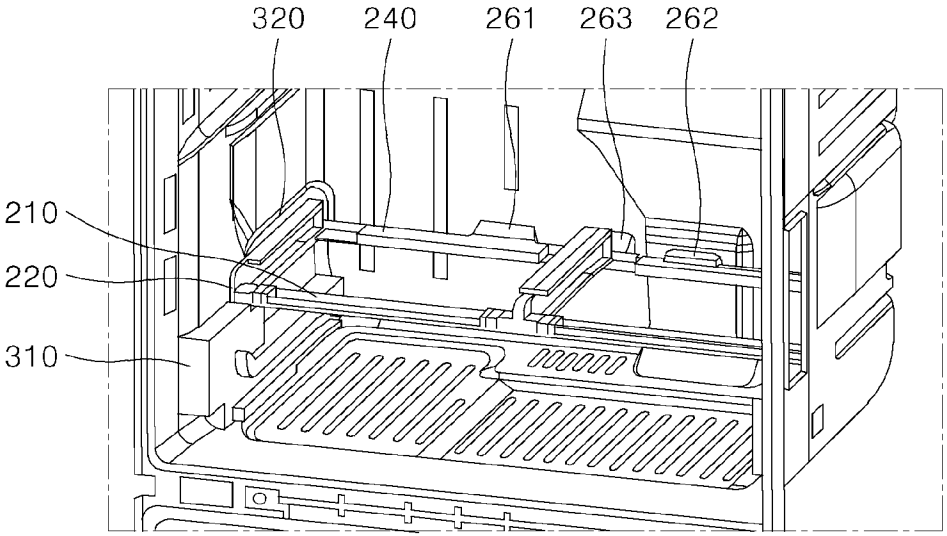
FIG. 13 is a schematic view showing that a frame is held in the refrigerating compartment of the refrigerator of one embodiment.

FIG. 12 is a schematic view showing the refrigerating compartment 51 of the refrigerator 1 of one embodiment, and FIG. 13 is a schematic view showing that a frame 200 is held in the refrigerating compartment 51 of the refrigerator 1 of one embodiment. Referring to FIG. 12, a front holding part (or front holding protrusion) 310 and a side holding part (or side holding protrusion) 320 may be disposed on a lateral surface of the refrigerating case 41, and a first rear holding part (or first rear holding protrusion) 331, a second rear holding part (or second rear holding protrusion) 332, and a third rear holding part (or third rear holding protrusion) 333 may be disposed on the rear surface of the refrigerating case 41.

The front holding part 310 may protrude inward from a lateral surface of the refrigerating case 41. As described with reference to FIG. 4, the refrigerator 1 of one embodiment may comprise a pantry compartment that is disposed in the refrigerating compartment 51 and comprises a pantry drawer capable of moving along a rail in a sliding manner. The front holding part 310 may be a front end portion of the rail to which the pantry drawer is movably coupled.

The side holding part 320 may protrude inward from a lateral surface of the refrigerating case 41 and be elongated in the front-rear direction. The side holding part 320 may comprise a first side holding part and a second side holding part over the first side holding part.

FIG. 12 shows the front holding part 310 and the side holding part 320 that are disposed on the inner surface of the left side of the refrigerating case 41 only, when viewed from the front. However, the front holding part 310 and the side holding part 320 in FIG. 12 may be disposed on the inner surface of the right side of the refrigerating case 41 in a way that the front holding part 310 and the side holding part 320 on the inner surface of the left side of the refrigerating case 41 are symmetrical to the front holding part 310 and the side holding part 320 on the inner surface of the right side of the refrigerating case 41. That is, the front holding part 310 may comprise a left front holding part disposed on the inner surface of the left side of the refrigerating case 41, and a right front holding part disposed on the inner surface of the right side of the refrigerating case 41. Likewise, the side holding part 320 may comprise a left side holding part disposed on the inner surface of the left side of the refrigerating case 41, and a right side holding part disposed on the inner surface of the right side of the refrigerating case 41.

Each of the first rear holding part 331, the second rear holding pat 332 and the third rear holding part 333 may protrude forward from the rear surface of the refrigerating case 41. The third rear holding part 333 may protrude forward from the front surface of the rear surface protrusion part 62 of the refrigerating case 41.

Referring to FIG. 13, both ends, i.e., the left end and the right end, of the front frame 210 of the frame 200 may be held at the front holding part 310. The first side frame 220 of the frame 200 may be held at the side holding part 320 formed on the left surface of the refrigerating case 41. Specifically, the first side holding part of the side holding part 320 may support the lower area of the first side frame 220. The second side holding part of the side holding part 320 may support the upper area of the first side frame 220.

Each of the first rear holding part 331, the second rear holding part 332 and the third rear holding part 333 in FIG.

12 may be supported by each of the first frame holding part 261, the second frame holding part 262 and the third frame holding part 263. Specifically, each of the first rear holding part 331, the second rear holding part 332 and the third rear holding part 333 may be inserted into a groove of each of the first frame holding part 261, the second frame holding part 262 and the third frame holding part 263.

In one aspect, provided is a refrigerator that ensures improvement in the rigidity of a frame supporting a storage drawer. In one aspect, provided is a refrigerator that helps to reduce the thickness of a frame as well as ensuring improvement in the rigidity of the frame. In one aspect, provided is a refrigerator that ensures the rigidity of a frame while incurring low costs.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via components and combinations thereof that are described in the appended claims.

A refrigerator of one embodiment may comprise a frame that supports a storage drawer in a way that the storage drawer can be drawn, and a supporter that is elongated in the left-right direction and coupled to the lower portion of the frame, and the supporter may be coupled to the frame through a hole that penetrates in the front-rear direction.

A refrigerator of one embodiment may comprise a frame that supports a storage drawer in a way that the storage drawer can be drawn, and a supporter that is elongated in the left-right direction and coupled to the lower portion of the frame, and the supporter may comprise a first support part that is elongated in the left-right direction, a second support part that is disposed under the first support part and elongated in the left-right direction, and a third support part that is elongated in the left-right direction and connects between one end of the first support part and one end of the second support part.

A refrigerator of one embodiment comprises a frame being held at a refrigerating case, a storage drawer being supported by the frame and moving in a front-rear direction with respect to the frame, and a supporter being coupled to the frame, and the supporter comprises a first supporter panel having a first width in the front-rear direction and having a plate shape elongated in a left-right direction, a third supporter panel being disposed under the first supporter panel, having a second width in the front-rear direction and having a plate shape elongated in the left-right direction, and a second supporter panel connecting between the first supporter panel and the second supporter panel, having a predetermined height in an up-down direction and having a plate shape elongated in the left-right direction.

In the refrigerator of one embodiment, the second supporter panel may have a supporter panel coupling hole that is formed in a way that penetrates in the front-rear direction, the frame may have a frame panel coupling hole that is formed in a way that penetrates in the front-rear direction, and the supporter may be coupled to the frame by a bolt that passes through the supporter panel coupling hole and the frame panel coupling hole.

In the refrigerator of one embodiment, the frame may comprise a front frame being elongated in the left-right direction, a first side frame a front end of which connects to a left side of the front frame, a second side frame a front end of which connects to a right side of the front frame, and a rear frame connecting between a rear end of the first side frame and a rear end of the second side frame, and the supporter may be coupled to the front frame.

In the refrigerator of one embodiment, the front frame may comprise a first frame panel having a predetermined width in the front-rear direction and having a plate shape elongated in the left-right direction, a second frame panel being disposed at a lower side of the first frame panel, having a predetermined height in the up-down direction and having a plate shape elongated in the left-right direction, and a third frame panel being disposed at the lower side of the first frame panel, at a front of the second frame panel, having a predetermined height in the up-down direction, and having a plate shape elongated in the left-right direction, and the supporter may be inserted into a space formed by the first frame panel, the second frame panel and the third frame panel.

In the refrigerator of one embodiment, a lower end of the third frame panel may contact an upper surface of the third supporter panel. In the refrigerator of one embodiment, an upper surface of the first supporter panel may contact a lower surface of the first frame panel.

In the refrigerator of one embodiment, a frame panel coupling hole may be formed on the second frame panel in a way that penetrates in the front-rear direction, a supporter panel coupling hole may be formed on the second supporter panel in a way that penetrates in the front-rear direction, and the supporter may further comprise a bolt passing through the frame panel coupling hole and the supporter panel coupling hole and coupling the supporter to the frame.

In the refrigerator of one embodiment, the refrigerating case may comprise a left front holding part which protrudes inward from an inner surface of a left side of the refrigerating case and at which a left end portion of the front frame is held, and a right front holding part which protrudes inward from an inner surface of a right side of the refrigerating case and at which a right end portion of the front frame is held.

In the refrigerator of one embodiment, the refrigerating case may comprise a left side holding part which protrudes inward from the inner surface of the left side of the refrigerating case and at which the first side frame is held, and a right side holding part which protrudes inward from the inner surface of the right side of the refrigerating case and at which the second side frame is held.

In the refrigerator of one embodiment, the left side holding part may comprise a first left side holding part supporting a lower portion of the first side holding part, and a second left side holding part being disposed over the first left side holding part and supporting an upper portion of the first side holding part. In the refrigerator of one embodiment, the refrigerating case may comprise a rear holding part protruding forward form a rear surface of the refrigerating case and supporting the rear frame.

In the refrigerator of one embodiment, the frame may further comprise a first frame holding part being disposed at one side in the left-right direction with respect to a middle of the rear frame in the left-right direction and having a first groove therein, and a second frame holding part being disposed at the other side in the left-right direction with respect to the middle of the rear frame in the left-right direction and having a second groove therein, and the rear holding part may comprise a first rear holding part protruding forward from the rear surface of the refrigerating case to be inserted into the first groove, and a second rear holding part protruding forward from the rear surface of the refrigerating case to be inserted into the second groove.

In the refrigerator of one embodiment, a first distance between the first side frame and a middle of the first frame holding part, a second distance between the middle of the first frame holding part and a middle of the second frame holding part, and a third distance between the middle of the second frame holding part and the second side frame may be substantially the same.

The refrigerator of one embodiment may further comprise a refrigerating compartment cold air supply duct being disposed in the refrigerating case, in an upper portion of the rear surface of the refrigerating case and supplying cold air to a refrigerating compartment that is formed by the refrigerating case, a connection duct being disposed between the refrigerating case and an outer case, in a lower portion of the rear surface of the refrigerating case and supplying cold air to the refrigerating compartment cold air supply duct, and a rear surface protrusion part protruding toward an inside of the refrigerating case and having the connection duct at a rear thereof, and the second rear holding part may be disposed at the rear surface protrusion part. In the refrigerator of one embodiment, the first frame holding part may protrude rearward from a rear surface of the rear frame, and the second frame holding part may be concave forward on the rear surface of the rear frame.

In the refrigerator of one embodiment, the frame further comprise a third frame holding part being disposed in the middle of the rear frame in the left-right direction and having a third groove therein, and the rear holding part may further comprise a third rear holding part protruding forward from the rear surface of the refrigerating case to be inserted into the third groove.

A refrigerator of one embodiment may ensure improvement in the rigidity of a frame supporting a storage drawer. The refrigerator of one embodiment may help to reduce the thickness of a frame while ensuring improvement in the rigidity of the frame, resulting in a substantial increase in the size of a storage space. The refrigerator of one embodiment may ensure the rigidity of a frame while incurring low costs. Specific effects are described along with the above-described effects in the detailed description.

The embodiments are described above with reference to a number of illustrative embodiments thereof. However, embodiments are not limited to the embodiments and drawings set forth herein, and numerous other modifications and embodiments can be drawn by one skilled in the art within the technical scope of the disclosure. Further, the effects and predictable effects based on the configurations in the disclosure are to be included within the scope of the disclosure though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a frame received in a case;

a storage drawer supported by the frame and configured to move in a front-rear direction of the refrigerator with respect to the frame; and a supporter coupled to the frame, the supporter including:

a first supporter panel having a first width in the front-rear direction of the refrigerator and having a plate shape that is elongated in a left-right direction of the refrigerator;

a third supporter panel positioned under the first supporter panel, having a second width in the front-rear direction of the refrigerator, and having a plate shape that is elongated in the left-right direction of the refrigerator; and a second supporter panel provided between the first supporter panel and the third supporter panel, having a predetermined height in an up-down direction of the refrigerator, and having a plate shape elongated in the left-right direction of the refrigerator, wherein the storage drawer is disposed on an upper side of the frame based on the storage drawer moving to a rearmost position, wherein both of the first supporter panel and the third supporter panel are directly coupled to a same surface of the second supporter panel, and wherein at least a part of the first supporter panel overlaps the third supporter panel in the up-down direction.

2. The refrigerator of claim 1, wherein the second supporter panel comprises a supporter panel coupling hole that penetrates the second supporter panel in the front-rear direction, the frame comprises a frame panel coupling hole that penetrates the frame in the front-rear direction, and the supporter is coupled to the frame by a coupling that passes through the supporter panel coupling hole and the frame panel coupling hole.

3. The refrigerator of claim 1, wherein the frame comprises:

a front frame that is elongated in the left-right direction;

a first side frame having a first end that connects to a first side of the front frame;

a second side frame having a first end that connects to a second side of the front frame; and a rear frame provided between a second end of the first side frame and a second end of the second side frame, and wherein the supporter is coupled to the front frame.

4. The refrigerator of claim 3, wherein the front frame comprises:

a first frame panel having a predetermined width in the front-rear direction and having a plate shape that is elongated in the left-right direction;

a second frame panel positioned below the first frame panel, having a first predetermined height in the up-down direction, and having a plate shape that is elongated in the left-right direction; and a third frame panel positioned below the first frame panel and at a front of the second frame panel, having a second predetermined height in the up-down direction, and having a plate shape that is elongated in the left-right direction, and wherein the supporter is received in a space formed by the first frame panel, the second frame panel and the third frame panel.

5. The refrigerator of claim 4, wherein a lower end of the third frame panel contacts an upper surface of the third supporter panel.

6. The refrigerator of claim 4, wherein an upper surface of the first supporter panel contacts a lower surface of the first frame panel.

7. The refrigerator of claim 4, wherein a frame panel coupling hole penetrates the second frame panel in the front-rear direction, a supporter panel coupling hole penetrates the second supporter panel in the front-rear direction, and the supporter further comprises a coupling passing through the frame panel coupling hole and the supporter panel coupling hole and coupling the supporter to the frame.

8. The refrigerator of claim 4, wherein the front frame includes a fourth frame panel having a predetermined height in the up-down direction, having a plate shape elongated in the left-right direction, and connected to a front end of the first frame panel.

9. The refrigerator of claim 8, wherein the frame includes:

a wheel housing provided over the front frame and coupled to the fourth frame panel; and a wheel rotatably coupled to the wheel housing and configured to contact a lower surface of the storage drawer when the storage drawer is withdrawn.

10. The refrigerator of claim 3, wherein the case comprises:

a left front holding protrusion which protrudes inward from an inner surface of a left side of the case and is configured to support a left end portion of the front frame, and a right front holding protrusion which protrudes inward from an inner surface of a right side of the case and is configured to support a right end portion of the front frame.

11. The refrigerator of claim 3, wherein the case comprises:

a left side holding protrusion which protrudes inward from an inner surface of a left side of the case and is configured to support the first side frame; and a right side holding protrusion which protrudes inward from an inner surface of a right side of the case and is configured to support the second side frame.

12. The refrigerator of claim 11, wherein the left side holding protrusion comprises:

a first left side holding protrusion configured to support a lower portion of the first side frame; and a second left side holding protrusion positioned over the first left side holding protrusion and configured to support an upper portion of the first side frame.

13. The refrigerator of claim 3, wherein the case comprises a rear holding protrusion protruding forward form a rear surface of the case and configured to the rear frame.

14. The refrigerator of claim 13, wherein the frame further comprises:

a first frame holding region provided at a first side in the left-right direction with respect to a middle of the rear frame in the left-right direction and having a first groove therein; and a second frame holding region provided at a second side in the left-right direction with respect to the middle of the rear frame in the left-right direction and having a second groove therein, and wherein the rear holding protrusion includes:

a first rear holding protrusion protruding forward from the rear surface of the case and configured to be inserted into the first groove; and a second rear holding protrusion protruding forward from the rear surface of the case and configured to be inserted into the second groove.

15. The refrigerator of claim 14, wherein a first distance between the first side frame and a middle of the first frame holding region, a second distance between the middle of the first frame holding region and a middle of the second frame holding region, and a third distance between the middle of the second frame holding region groove and the second side frame are substantially similar.

16. The refrigerator of claim 14, further comprising:

a refrigerating compartment cold air supply duct provided in the case in an upper portion of the rear surface of the case, and configured to supply supplying cold air to a refrigerating compartment that is formed by the case;

a connection duct provided between the case and an outer case in a lower portion of the rear surface of the case, and configured to supply cold air to the refrigerating compartment cold air supply duct; and a rear surface protrusion protruding toward an inside of the case and having the connection duct at a rear thereof, wherein the second rear holding region is positioned at the rear surface protrusion.

17. The refrigerator of claim 16, wherein the first frame holding region protrudes rearward from a rear surface of the rear frame, and the second frame holding region is concave forward on the rear surface of the rear frame.

18. The refrigerator of claim 14, wherein the frame further comprises a third frame holding region positioned in the middle of the rear frame in the left-right direction, and including a third groove therein, and wherein the rear holding protrusion further comprises a third rear holding protrusion protruding forward from the rear surface of the case and configured to be inserted into the third groove.

19. The refrigerator of claim 1, wherein the supporter directly contacts a lower surface of the frame and is configured to support the storage drawer in the up-down direction.

20. The refrigerator of claim 1, wherein the frame comprises a front frame that is elongated in the left-right direction, wherein the front frame comprises a first frame panel having a predetermined width in the front-rear direction and having a plate shape that is elongated in the left-right direction, and wherein an upper surface of the first supporter panel directly contacts a lower surface of the first frame panel.

* * * * *